United States Patent [19]

Pleasants

[11] Patent Number: 5,040,598

[45] Date of Patent: Aug. 20, 1991

[54] PULLING TOOL FOR USE WITH REELED TUBING AND METHOD FOR OPERATING TOOLS FROM WELLBORES

[75] Inventor: Charles W. Pleasants, Carrollton, Tex.

[73] Assignee: Otis Engineering Corporation, Dallas, Tex.

[21] Appl. No.: 565,218

[22] Filed: Aug. 6, 1990

Related U.S. Application Data

[63] Continuation of Ser. No. 345,899, May 1, 1989, abandoned.

[51] Int. Cl.[5] ..... E21B 31/18

[52] U.S. Cl. ..... 166/98; 166/301; 166/381

[58] Field of Search ..... 166/50, 98, 99, 125, 166/178, 212, 215, 217, 301, 318, 377, 381, 383, 384, 386; 175/293, 296, 299, 300, 301, 304; 294/86.1, 86.21, 86.24, 86.25, 86.29, 86.33

[56] References Cited

U.S. PATENT DOCUMENTS

| | | | |
|---|---|---|---|
| 1,927,836 | 9/1933 | Kightlinger . | |
| 2,499,695 | 3/1950 | Storm . | |
| 2,828,822 | 4/1958 | Greer . | |
| 2,851,110 | 9/1958 | Greer . | |
| 3,051,239 | 8/1962 | Dollison . | |
| 3,051,243 | 8/1962 | Grimmer et al. | 166/224 |
| 3,088,533 | 5/1963 | Sutliff | 175/297 |
| 3,208,531 | 9/1965 | Tamplen | 166/125 |
| 3,393,002 | 7/1968 | Woolley | 294/86.23 |
| 3,405,773 | 10/1968 | Sutliff et al. | 175/297 |
| 3,796,707 | 1/1989 | Halbardier | 166/387 |
| 3,944,273 | 3/1976 | Ahlstone | 294/86.1 |
| 3,946,819 | 3/1976 | Hipp | 175/296 |
| 3,949,821 | 4/1976 | Raugust | 175/297 |
| 4,093,294 | 6/1978 | Taylor | 294/86.25 |
| 4,161,224 | 7/1979 | Hostrup | 175/297 |
| 4,175,778 | 11/1979 | Nunez et al. | 285/3 |
| 4,179,002 | 12/1979 | Young | 175/297 |
| 4,181,186 | 1/1980 | Blanton | 175/297 |
| 4,185,865 | 1/1980 | Taylor | 294/86.3 |
| 4,186,807 | 2/1980 | Sutliff et al. | 175/302 |
| 4,346,770 | 8/1982 | Beck | 175/297 |
| 4,396,061 | 8/1962 | Tamplen et al. . | |
| 4,436,150 | 3/1984 | Barker | 166/131 |
| 4,515,220 | 5/1985 | Sizer et al. | 166/384 |
| 4,558,895 | 12/1985 | Tamplen . | |
| 4,612,984 | 9/1986 | Crawford . | |
| 4,625,799 | 12/1986 | McCormick et al. | 166/223 |
| 4,646,830 | 3/1987 | Templeton | 166/178 |
| 4,682,657 | 7/1987 | Crawford . | |
| 4,685,516 | 8/1987 | Smith et al. . | |
| 4,708,208 | 11/1987 | Halbardier | 166/387 |
| 4,715,445 | 12/1987 | Smith | 166/377 |
| 4,759,406 | 7/1988 | Smith et al. . | |
| 4,767,145 | 8/1988 | Bullard . | |
| 4,793,417 | 12/1988 | Rumbaugh | 166/312 |
| 4,805,699 | 2/1989 | Halbardier | 166/387 |
| 4,844,166 | 7/1989 | Going, III et al. | 166/379 |
| 4,862,958 | 9/1989 | Pringle | 166/72 |

FOREIGN PATENT DOCUMENTS

| | | |
|---|---|---|
| 8400577 | 2/1984 | PCT Int'l Appl. . |
| 2089400 | 11/1981 | United Kingdom . |

*Primary Examiner*—Terry L. Melius

*Attorney, Agent, or Firm*—Warren B. Kice

[57] ABSTRACT

A pulling tool and method for pulling an operating tool from a downhole location in a wellbore in which an elongated tubular housing assembly is connectable to a section of reeled tubing and defines a longitudinal bore through which fluid passes from said reeled tubing. A passage extends through the housing assembly and communicates with the longitudinal bore of the housing assembly for discharging the fluid against the wall of the wellbore and the fishing neck of the operating tool to clean same. A latching assembly is disposed on the housing assembly for latching to the fishing neck of the operating tool as the housing assembly is inserted into the fishing neck to enable the fishing neck and the operating tool to be pulled from the wellbore. In the event the operating tool cannot be pulled from the wellbore, the flow of fluid through the passage of the housing assembly can be blocked to enable the fluid pressure to build up in the bore of the housing assembly, in which case the housing assembly operates to release the fishing neck to enable the housing assembly to be removed from the wellbore.

21 Claims, 5 Drawing Sheets

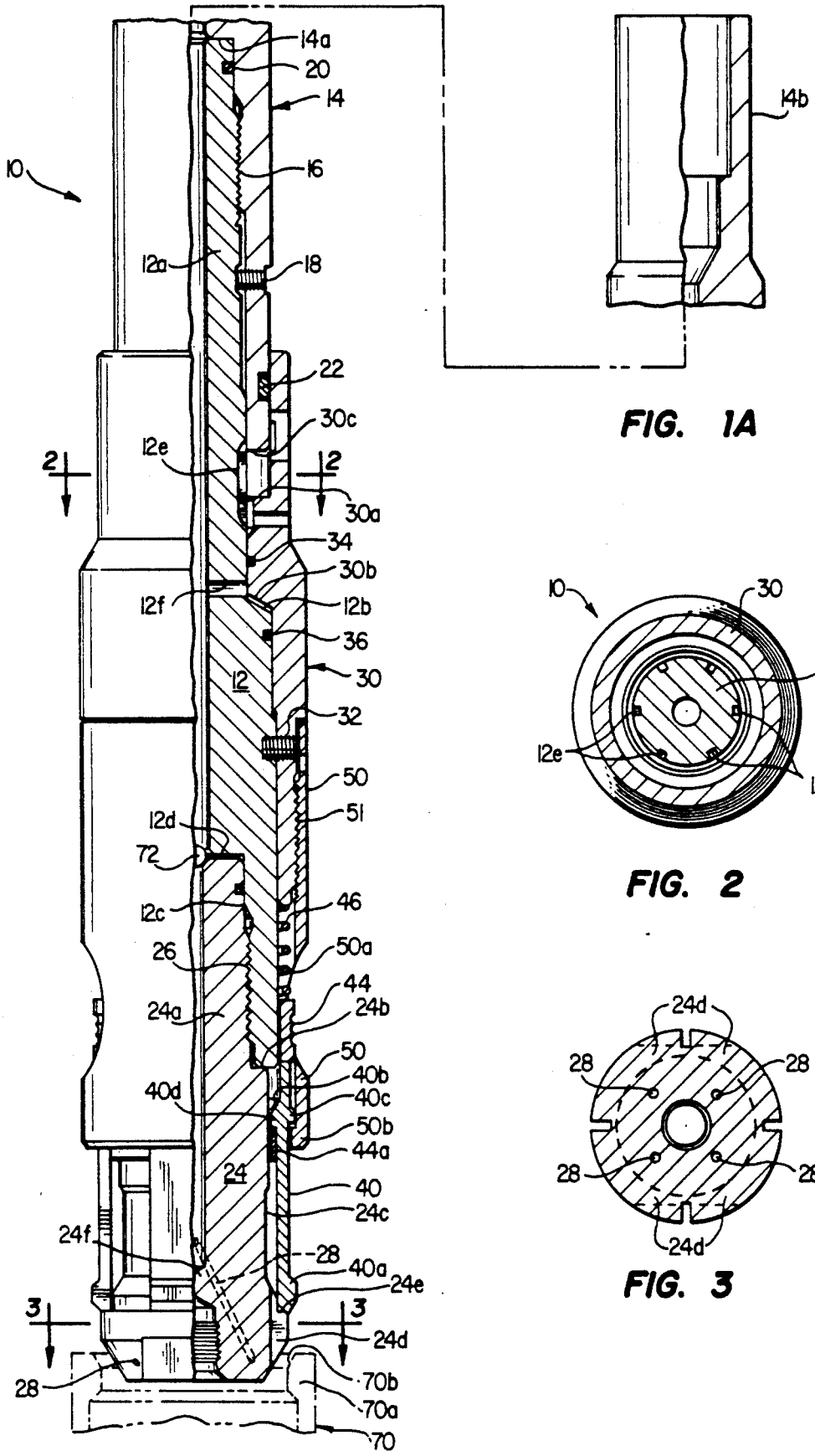
FIG. 1B
FIG. 1A
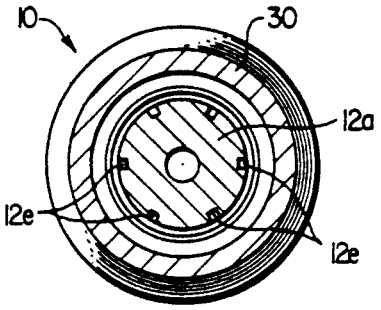
FIG. 2
FIG. 3

PULLING TOOL FOR USE WITH REELED TUBING AND METHOD FOR OPERATING TOOLS FROM WELLBORES

This is a continuation of co-pending application Ser. No. 345,899 filed on May 1, 1989.

BACKGROUND OF THE INVENTION

This invention relates to a pulling tool and method for removing tools from an oil or gas wellbore, and, more particularly, to such a tool and method which can be used with reeled tubing.

Downhole well operating tools are often used in completed wellbores for performing several functions. Typically, these tools are lowered by a wire line into a downhole location, which can be defined by a landing nipple or the like, and are releasably anchored at their downhole location by a locking mandrel. When it is desired to pull the operating tool out of the wellbore, a pulling tool is used which has a latching assembly for latching to a fishing neck on the locking mandrel to enable the operating tool to be pulled from the wellbore.

However, these types of pulling tools are often ineffective in removing operating tools from wellbores, especially when the tool is jammed in the wellbore and/or when the wellbore is "deviated," i.e., at least a portion of the wellbore extends in a horizontal, or substantially horizontal, position.

Other limitations in pulling tools are in connection with coiled, or reeled, tubing which replaces the wire line and enables fluids such as water, nitrogen, diesel fuel, corrosion inhibitor, foam acid, etc. to be introduced into the wellbore, as disclosed, for example, in U.S. Pat. No. 4,793,417. In these situations two separate procedures are required, one involving connecting a separate nozzle, or the like, to the reeled tubing, inserting same the wellbore to introduce the fluid into the wellbore and then removing the nozzle from the wellbore. Then the pulling tool is connected to the reeled tubing and inserted into the wellbore to remove the operating tool. The expenditure of time and effort to complete these steps is compounded in cases where the fluid is used to clean sand, or the like, from around the operating tool prior to its removal since after the initial cleaning, the sand tends to settle back into the operating area during the time it takes to remove the nozzle from the wellbore and insert the pulling tool.

SUMMARY OF THE INVENTION

It is therefore an object of the present invention to provide a pulling tool and method of the above type in which the tool easily latches to a fishing neck for pulling an operating tool from a wellbore.

It is a further object of the present invention to provide a pulling tool and method of the above type which can be utilized with reeled tubing and can be inserted into a horizontal, or deviated, wellbore.

It is a further object of the present invention to provide a pulling tool and method of the above type in which fluid can be simultaneously introduced through the reeled tubing and the pulling tool to clean the operating area of sand, dirt or other debris during operation of the pulling tool.

It is a further object of the present invention to provide a pulling tool and method of the above type in which the pulling tool can be released from the fishing neck of the operating tool in the wellbore by hydraulic pressure in the event the operating tool cannot be removed from the wellbore.

Toward the fulfillment of these and other objects, according to the present invention an elongated tubular housing assembly is connectable to a section of reeled tubing and defines a longitudinal bore through which fluid from the reeled tubing passes. A passage extends through the housing assembly and communicates with its bore for discharging the fluid against the wall of the wellbore and the operating tool to clean same. A latching assembly is disposed on the housing assembly for latching to the fishing neck of the operating tool as the housing assembly is inserted into the fishing neck to enable the fishing neck and the operating tool to be pulled from the wellbore. In the event the operating tool cannot be pulled from the wellbore, the flow of fluid through the passage of the housing assembly can be blocked to enable the fluid pressure to build up in the bore of the housing assembly. The housing assembly operates in response to the build up of this fluid pressure to release the fishing neck and enable the pulling tool to be removed from the wellbore.

BRIEF DESCRIPTION OF THE DRAWINGS

The above brief description, as wellbore as further objects, features and advantages of the present invention will be more fully appreciated by reference to the following detailed description of the presently preferred but nonetheless illustrative embodiments in accordance with the present invention when taken in conjunction with the accompanying drawings wherein:

FIGS. 1A and 1B are longitudinal sectional views of the pulling tool of the present invention, with FIG. 1A being an upward continuation of FIG. 1B;

FIGS. 2 and 3 are traverse sectional views taken along the lines 2—2, and 3—3 of FIG. 1B;

DESCRIPTION OF THE PREFERRED EMBODIMENT

Figure 4A:
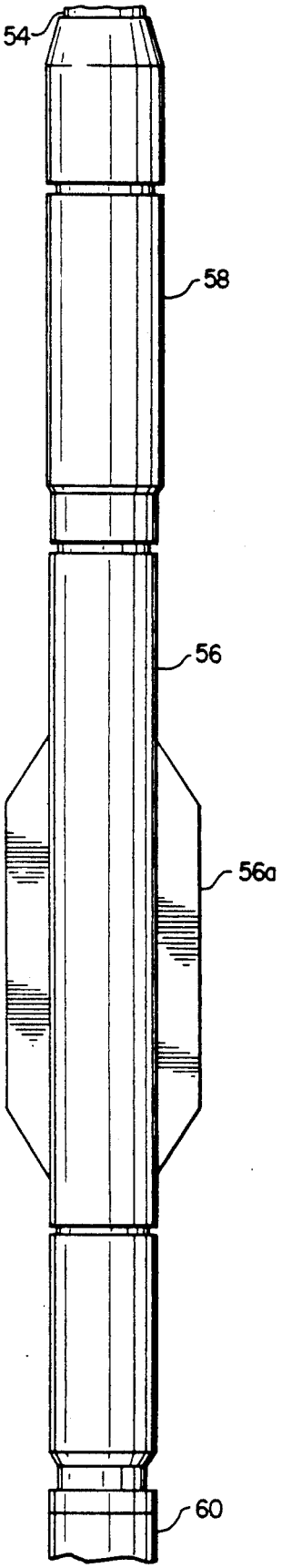
FIGS. 4A–4F are elevational views depicting a series of associated components connected between the end of a section of reeled tubing and the pulling tool of FIGS. 1–3, with FIG. 4B being a downward continuation of FIG. 4A, FIG. 4C being a downward continuation of FIG. 4B, FIG. 4D being a downward continuation of FIG. 4C, FIG. 4E being a downward continuation of FIG. 4D and FIG. 4F being a downward continuation of FIG. 4E.

Referring specifically to FIGS. 1A and 1B of the drawings, the reference numeral 10 refers, in general, to the pulling tool of the present invention which includes a housing assembly formed by an inner mandrel 12 having a reduced diameter portion **12*a* defining an outer shoulder 12*b*, and a counterbore 12*c* which defines an inner shoulder 12*d*. As also shown in FIG. 2, six axially extending slots 12*e*, angularly spaced at 60° degree intervals, are spaced around the outer surface of the mandrel portion 12***a*. Also, six radially extending through passages 12*f* (only one of which is shown in FIG. 1B), also spaced at 60° intervals, are provided through the mandrel portion 12*a* for reasons to be described.

The housing assembly also includes a tubular crossover 14 extending over the end portion of the mandrel portion 12*a* in a telescoping coaxial relationship thereto with their respective bores in registry. Threads 16 are formed on the outer surface of the mandrel portion 12*a* and the inner bore of the crossover 14 to enable the mandrel to be inserted into the end of the crossover in a telescoping, coaxial relationship and secured thereto.

An inner shoulder 14*a* is formed on the inner surface of the crossover against which the corresponding end of the mandrel 12 abutts. The free end portion 14*b* (FIG. 1A) of the crossover 14 has an enlarged bore for receiving an appropriately configured end portion of a reeled tubing (not shown), or a component such as a hydraulic jar or the like, as will be described, so that the pulling tool 10 can be inserted into and pulled from a wellbore.

A set screw 18 extends through the corresponding opening formed in the crossover 14 and engages in the corresponding notch formed in the outer surface of the mandrel portion 12*a*. An O-ring 20 extends in a groove formed in the outer surface of the mandrel portion 12*a* and engages an inner surface portion of the crossover 14 to provide a fluid seal. A snap ring 22 extends in a groove formed in the outer surface of the crossover 14 for reasons that will be described.

The housing assembly also includes a tubular core 24 which has a reduced diameter portion 24*a* extending within the corresponding end portion of the inner mandrel 12. The reduced diameter portion 24*a* of the core 24 defines a shoulder 24*b* against which the corresponding end of the mandrel 12 abutts.

Threads 26 are formed on the inner surface of the counterbore 12*c* of the mandrel 12 and the corresponding outer surface of the reduced diameter portion 24*a* of the core 24 to enable the core to be inserted into the end of the mandrel in a telescoping coaxial relationship and secured thereto. The bore of the core 24 is in registery with the bore of the mandrel 12 so that a continuous longitudinal bore is formed through the entire housing assembly formed by the registering bores of the crossover 14, the mandrel 12, and the core 24. It is noted that the diameter of the bore of the core 24 is less than that of the mandrel 12 so that a portion of the core projects radially inwardly from the mandrel for reasons to be described. The other end portion of the core 24 has a reduced diameter portion 24*c* and four flanges 24*d* (FIG. 3) which define a shoulder 24*e* for reasons that will be described. This end portion of the core is closed as shown by the reference 24*f*.

As also shown in FIG. 3, four fluid passages 28 are provided through the core 24 and are angularly spaced at 90° intervals. Each passage 28 registers with the bore of the core 24 and extends from the inner diameter of the core to the end of the core and at an angle to the longitudinal axis of the core. The ends of the passages 28 at the end of the core 24 are of a reduced diameter to create a jet nozzle effect when fluid is passed therethrough, as will be described.

An outer mandrel, or tubular piston, 30 extends around the intermediate portion of the inner mandrel 12 and has internal bore portions of varying diameters which define two spaced internal shoulders 30*a* and 30*b*. In the normal position of the piston 30, the shoulders 30*a* and 30*b* are in a spaced relation to the corresponding end surfaces of the crossover 14 and the shoulder 12*b* of the mandrel 12 respectively.

A pair of diametrically opposed shear pins 32 (one of which is shown in FIG. 1B) extend through a pair of through openings in the piston 30 and into corresponding openings in the mandrel 12 for reasons to be described. The upper end portion of the piston 30 overlaps a corresponding end portion of the crossover 14 and a continuous groove 30*c* is formed in the overlapping inner surface of the piston 30. The groove 30*c* is sized so as to receive the snap ring 22 under conditions that will be described. An O-ring 34 extends in a groove formed in the inner surface of the piston 30 and engages an outer surface of the mandrel portion 12*a*, and an O-ring 36 extends in a groove formed in the outer surface of the mandrel 12 and engages an inner surface of the piston for providing fluid sealing.

Four retaining dogs 40 are angularly spaced at 90° intervals around the outer surface of the core 24 including the reduced diameter portion 24*c*. Each dog 40 has an enlarged end portion 40*a* which normally engages the shoulder 24*e* of the core 24, with a portion of the end portion 40*a* projecting radially outwardly from the flange 24*d* of the core 24. Each dog 40 also has a ramp portion 40*b* adjacent its other end, along with an external shoulder 40*c* and an internal shoulder 40*d*.

A retaining ring 44 extends around the outer surface of the lower end portion of the inner mandrel 12. Although not clear from FIG. 1B, it is understood that the retaining ring 44 has four windows angularly spaced at 90° intervals which extend over the corresponding end portion of the dogs 40. An internal shoulder 44*a* is formed on the retaining ring 44 which is normally engaged by the internal shoulder 40*d* of each dog 40. A compression spring 46 extends over the mandrel 12 and between the corresponding ends of the piston 30 and the retaining ring 44, and normally urges the ring in a downwardly direction as viewed in FIG. 1B.

A tubular housing 50 extends around an end portion of the piston 30, the spring 46, the retaining ring 44 and the corresponding end portions of the dogs 40 in a coaxial relationship thereto. Threads 51 are provided on the inner surface of the housing 50 and the corresponding overlapped outer surface of the piston 30 to secure the housing to the piston in a telescoping coaxial relationship. The housing 50 has two angularly spaced windows 50*a* formed therethrough which exposes the retaining ring 44. An inwardly-directed flange 50*b* is provided on the end of the housing 50 which normally extends adjacent the external shoulder 40*c* of each dog 40.

The tool 10 is attached to the end of one or more of a series or string of associated components depicted in FIGS. 4A–4F. More particularly, the lower end portion of a section of the reeled tubing shown by the reference numeral 54 in FIG. 4A is to connected to one end of a centralizer 56 by a connector 58. The centralizer 56 has an enlarged portion 56*a* which closely corresponds to the inner diameter of the wellbore and thus functions to limit the tilting and bending of the reeled tubing 54 in the well bore, and thus protect the other components below the centralizer.

One end of a knuckle-joint 60 (FIGS. 4A and 4B) is connected to the other end of the centralizer 56 in order to enable that portion of the assembly shown in FIGS. 4A–4F extending below the knuckle-joint 60 to bend relatively to that portion extending above the knuckle-joint. Thus the assembly can more easily traverse horizontal or deviated wells.

Figure 4B:
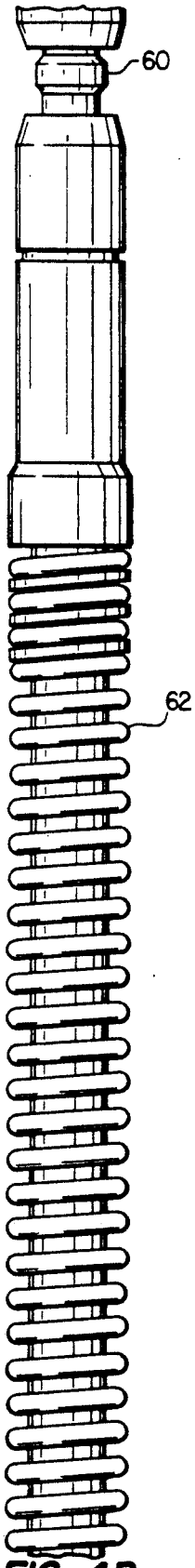
Figure 4C:
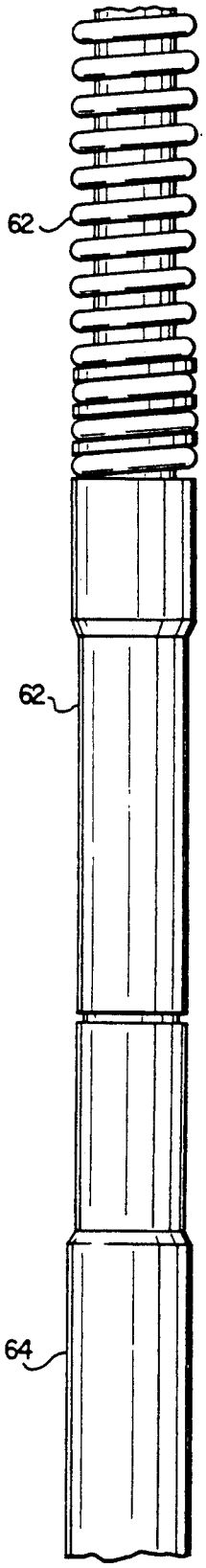

As shown in FIGS. 4B and 4C, the upper end of an accelerator 62 is connected to the lower end of the knuckle-joint 60 and functions to create spring forces to accelerate the pulling tool 10 to create high impact loading in an upwardly direction as will be described. Since the accelerator 62 functions in a conventional manner it will not be described in any further detail.

Figure 4D:
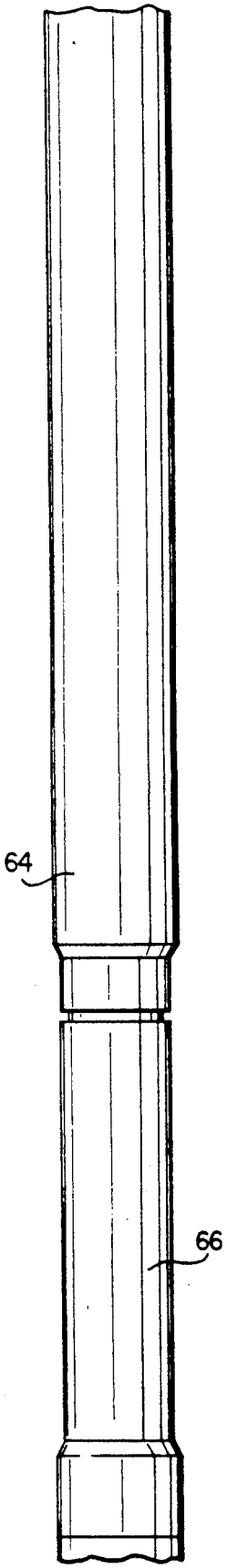
Figure 4E:
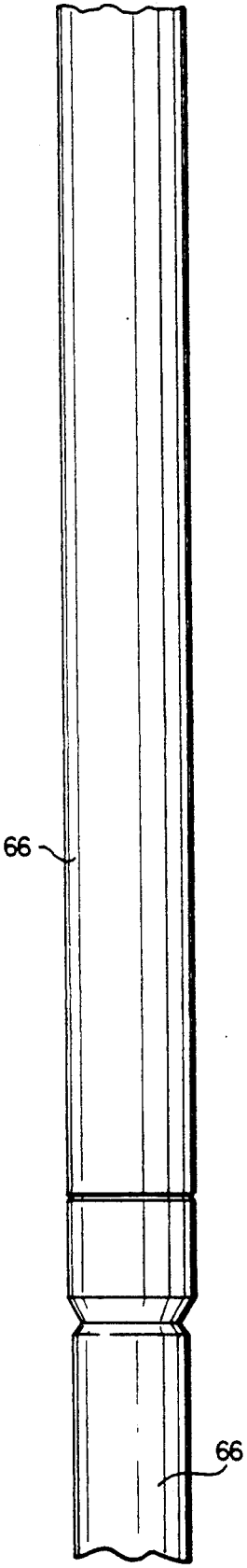
Figure 4F:
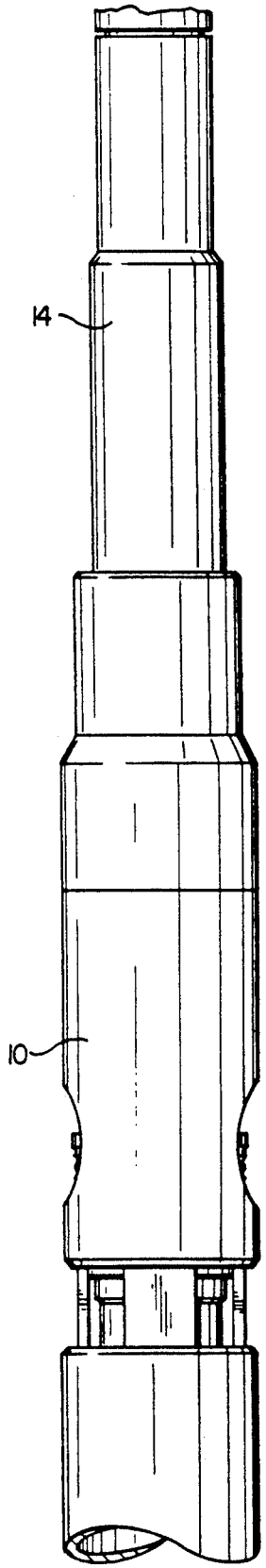

A weighted stem 64 (FIGS. 4C and 4D) connects the lower end of accelerator 62 to the upper end of a hydraulic jar 66. The stem 64 provides the increased weight and mass necessary to create the high impact loading discussed herein. The hydraulic jar 66 is depicted in FIGS. 4D and 4E and functions in cooperation with the accelerator 62 to provide high impact loading in an upwardly direction such as in the manner disclosed in U.S. patent application Ser. No. 269,996 filed Nov. 11, 1988 and assigned to the same assignee as the present invention. The lower end of the hydraulic jar 66 is connected to the upper end portion **14*b* of the tubular cross-over 14 of the pulling tool 10** as shown in FIG. 1A and as described above.

Figure 7:
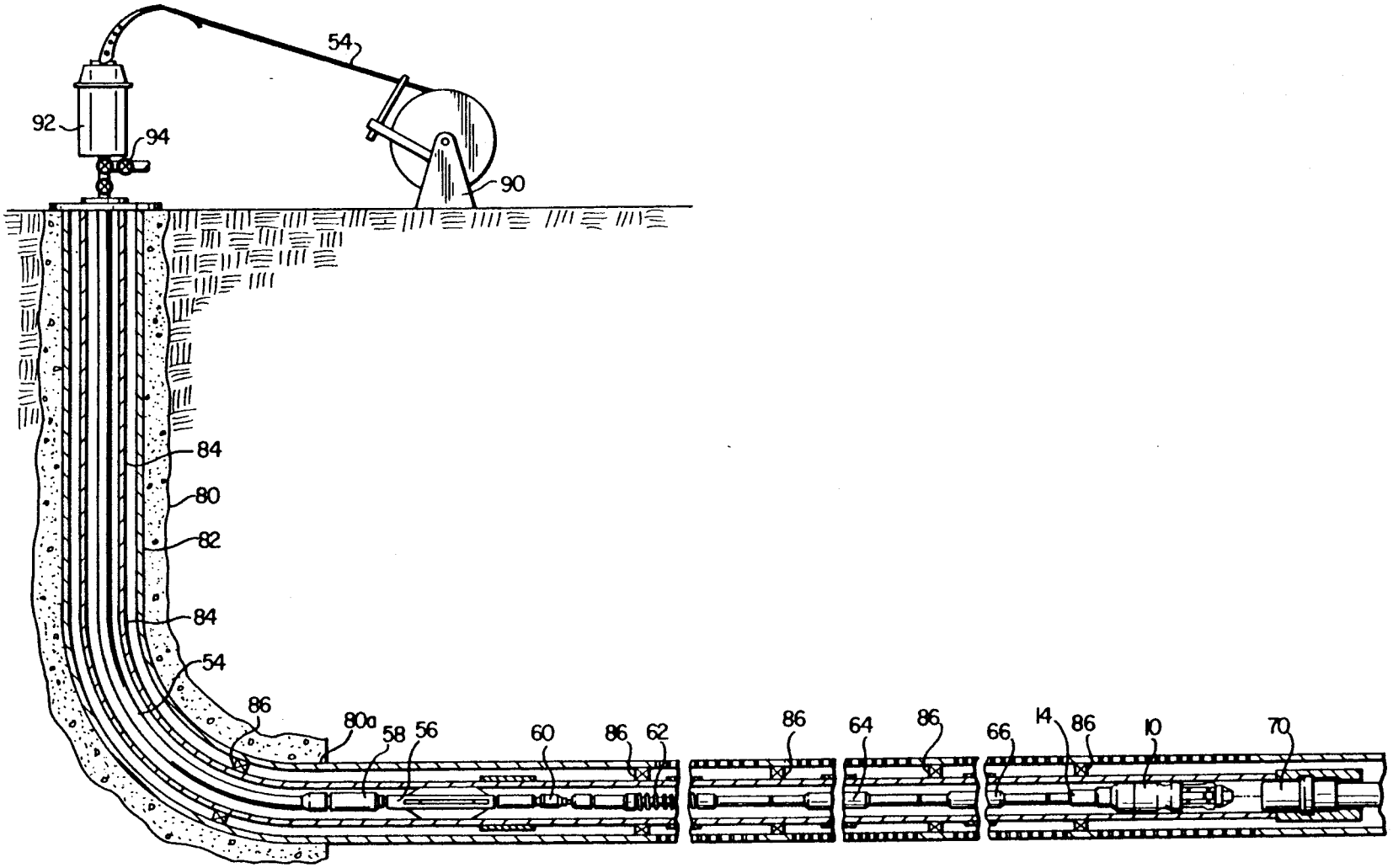
FIG. 7 is a schematic view, partially in elevation and section, and partially broken away, of an earth well showing the pulling tool of the present invention connected to the string of components of FIGS. 4A–4F disposed in a wellbore casing.

It is understood that each of the components shown in FIGS. 4A–4F, and discussed above, have a through bore for the flow of fluid therethrough so that fluid introduced into the reeled tubing 54 above ground flows through the tubing, the components of FIGS. 4A–4F, and to the pulling tool 10. It is also understood that all of the above described connections between the various components of FIGS. 4A–4F can be conventional and, as such, would normally consist of a male and female portions tubular portions in threaded engagement. Since these connections are conventional they will not be described in any further detail. The tool 10 is shown in FIG. 7 disposed in a deviated earth well 80 having a horizontal portion **80*a*. A casing 82 is cemented in the well 80 and a string of well tubing 84 is anchored and sealed in the casing 20 by a plurality of axially spaced packers 86. The tool 10 is connected at the end of the string of components including the reeled tubing 54, the centralizer 56, the connector 58, the knuckle joint 60, the accelerator 62, the stem 64, the jar 66 and the crossover 14. The tool 10 is shown in a slightly spaced relation to the fishing neck 70 which is connected to the tool (now shown) to be pulled from the well 80**.

The reeled tubing 54 is stored on a reel 90 above ground and is injected into the casing 82 by an injector 92. It is understood that a manifold (not shown) is provided which includes the necessary pumps, valves, and fluid reservoirs to discharge high pressure fluid into and through the reeled tubing 54. A wellhead valve system 94 is used to control vertical access to, and fluid communication with, the upper section of the tubing 84 and blowout preventers, or the like (now shown), can be installed to block fluid flow during emergency conditions.

The operation of the pulling tool 10 of the present invention will be described assuming that it is desired to retrieve an operating tool (not shown) from a wellbore. As shown in FIG. 1B, an inside fishing neck 70 is attached to the operating tool, either directly or through a locking mandrel, and is of a conventional design and, as such, is provided with an enlarged end portion **70*a* defining an inner ramp 70*b***.

The reeled tubing, along with the tool 10 and the associated components depicted in FIGS. 4A–4F are inserted into the wellbore in any conventional manner such as that disclosed in U.S. Pat. No. 4,793,417. During this insertion, the pulling tool 10 is set in the position shown in FIG. 1B, i.e. with the dogs 40 extending parallel to the axis of the tool. It is noted that, even if the wellbore is deviated, the structural integrity of the reeled tubing enables the tool 10 to traverse the wellbore.

Fluid is introduced, via the reeled tubing, into the crossover 14 and passes through the continuous longitudinal bore of the housing assembly defined by the crossover 14, the mandrel 12 and the core 24. As the tool 10 traverses the wellbore, the fluid discharges at relative high pressure and velocity through the discharge orifices at the ends of the passages 28 and against the wall of the wellbore to clean same of sand, debris and the like until the tool reaches the proximity of the fishing neck 70.

Figure 5:
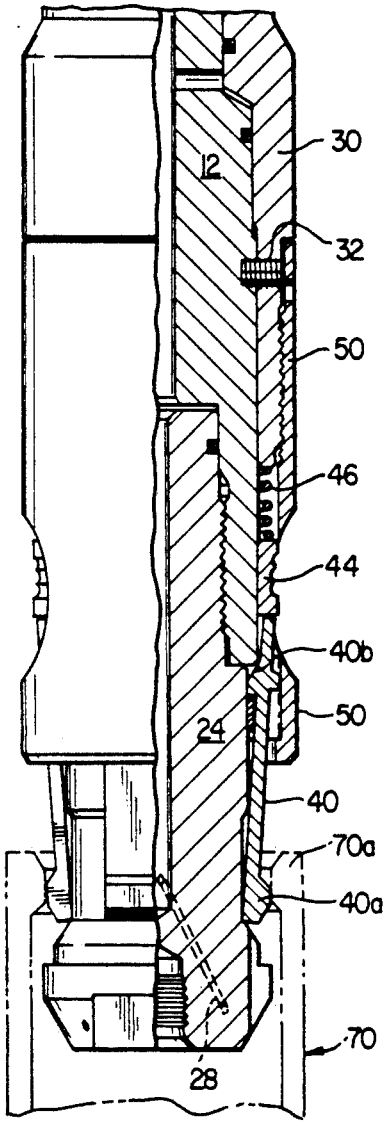
FIG. 5 is a partial view of the latching portion of the tool of FIGS. 1–3 showing the latching operation.
Figure 6:
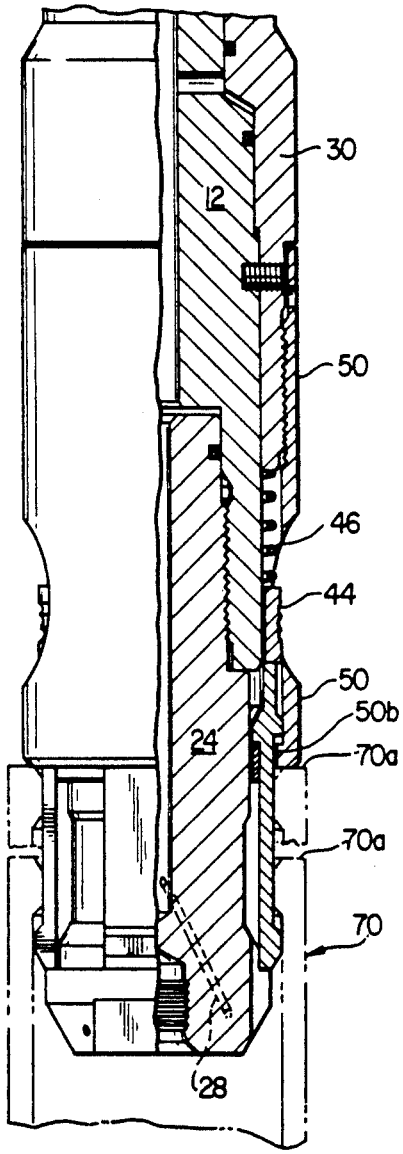
FIG. 6 is a view similar to FIG. 5 but showing the latching portion of the tool of the present invention after the latching operation is completed.

As the tool 10 approaches the fishing neck 70, the ramp **70*b* of the fishing neck will engage the projecting enlarged end portions 40*a* of the dogs 40 and force the end portions of the dogs upwardly and inwardly, and therefore the retaining ring 44 upwardly to compress the spring 46. This movement continues until the enlarged end portions 40*a* of the dogs 40 extend over the reduced diameter portion 24*c* of the core 24 and the ramp 40*b* of each dog engages the corresponding end of the mandrel 12. Further movement causes the dogs 40 to pivot about the shoulder 44*a* of the retaining ring 44 to the position shown in FIG. 5. In this position, the enlarged end portions 40*a* of the dogs 40 rest on the reduced diameter portion 24*c* of the core 24 and thus clear the enlarged end portion 70*a* of the fishing neck 70 as the tool 10 continues its downward movement relative to the fishing neck 70. As this occurs, the compressed spring 46, acting on the retaining ring 44, forces the dogs 40 downwardly, causing them to pivot back to the latching position shown in FIG. 6. Further movement of the tool 10 downwardly results in the end portion 70*a* of the fishing neck 70 engaging the flange 50*b* of the housing 50 as shown by the dashed lines in FIG. 6, thus preventing further downward movement of the tool 10 and signaling the operator that the enlarged end 40*a* of the dogs 40 are resting within, or below, the enlarged end portion 70*a* of the fishing neck 70** to complete the latching operation.

The tool 10 can then be pulled upwardly by pulling on the reeled tubing connected to the crossover 14, causing the upper ends of enlarged end portions **40*a* of the dogs to engage the lower end of the enlarged end portion 70*a* of the fishing neck 70. This transmits the upwardly directed forces to the operating tool connected to the fishing neck 70 to pull the operating tool out of the wellbore. It is noted that, when pulling upwardly, the force from the crossover 14 is transmitted to the inner mandrel 12, to the core shoulder 24*e*, to the enlarged end portions 40*a* of the dogs 40*a*, and to the fishing neck 70. Thus, the housing 50, the pins 32, and the piston 30 remain unloaded during the pulling operation. It is also noted that, during this entire operation, fluid can be continuously introduced, via the reeled tubing, into the longitudinal bore defined by the respective bores of the crossover 14, mandrel 12 and the core 24. The fluid discharges through the passages 28 to clean the fishing neck 70**, the operating tool, and the wall of the wellbore surrounding the latter tool.

In the event the operating tool connected to the fishing neck 70 cannot be removed from the wellbore by pulling the tool 10 or by providing high impact loading via the accelerator 62 and the jar 64 due to the fact that the wellbore is deviated, or due to severe jamming, or the like, the tool 10 can be actuated to disengage from the fishing neck 70. To this end, the tool 10 is allowed to move downwardly relative to the operating tool and the fishing neck 70 to create some slack in the reeled tubing. One or more small steel balls 72 (FIG. 1B) are then dropped into the reeled tubing and fall, by gravity and by the pressure of the fluid flowing through the tool 10, on the upper end of the core 24 that projects from the corresponding end of the inner mandrel 12. This seals off further flow of fluid through the bore of the core 24 and out the passages 28.

The fluid pressure in the bore of the mandrel 12 thus builds up and is forced through the passages 12*f* and into the space between the shoulder 12*b* of the mandrel 12 and the shoulder 30*b* of the piston 30. This fluid pressure acts on the shoulders 12*b* and 30*b* and on the O-rings 34 and 36 to force the piston 30, and therefore the housing 50, the dogs 40, the ring 44 and the spring 46, upwardly until the pins 32 are sheared. This movement of the piston 30 and the housing 50 causes the flange 50*b* of the housing to engage the external shoulders 40*c* of the dogs 40 and move the dogs upwardly. The ramps 40*b* of the dogs 40 thus engage the corresponding end of the mandrel 12 and pivot the dogs 40 above the retaining ring shoulder 44*a* which moves the enlarged end portions 40*a* of the dogs inwardly against the reduced diameter portion 24*c* of the core 24 and out of releasing engagement with the fishing neck 70.

This upward movement continues until the shoulder 30*a* of the piston 30 engages the corresponding end of the crossover 14 at which time a portion of the snap ring 22 snaps into the groove 30*c* of the piston 30. The piston 30, and therefore the housing 50, the ring 44, the spring 46 and the dogs 40 are thus secured to the mandrel 12. In this position, the O-ring 34 extends over the slots 12*e* of the mandrel 12 thus permitting the fluid to escape from the slots and relieve the fluid pressure. The operator is thus signaled that the dogs 40 have moved clear of the fishing neck 70 so that the tool 10 can be pulled from the fishing neck and from the wellbore. The slots 12*e* also allow fluid to drain from the reeled tubing as the tubing is pulled from the wellbore after the shear release.

The windows 50*a* are provided in the housing 50 to enable the retaining rings 44 to be manually engaged when the tool is out of the wellbore and on the ground surface to release the tool from the fishing neck 70. It is apparent from FIG. 6 that the tool 10 can also be mechanically actuated to disengage from the fishing neck 70 in the event that it is not desired or feasible to disengage it hydraulically as described above. To mechanically disengage the tool 10 from the fishing neck 70 the tool is pushed, via the reeled tubing 54, until the end portion 70*a* of the fishing neck 70 engages the flange 50*b* of the housing 50 as shown by the dashed lines in FIG. 6. Upon further downward movement of the tool 10, the end portion 70*a* of the fishing neck 70 pushes up on the housing 50 until the shear pins 32 shear, permitting movement of the housing 50 and the piston 30 relative to the mandrel 12 and the core 24. The tool 10 then operates as described above in connection with the hydraulic actuation, i.e., the upward movement of the housing 50 causes the flange 50*b* to pull upwardly on the external shoulders 40*c* and move the dogs 40 upwardly relative to the core 24. The ramps 40*b* of the dogs 40 thus engage the corresponding end of the mandrel 12 and pivot the dogs about the retaining ring shoulder 44*a*. The enlarged end portions 40*a* of the dogs 40 thus move inwardly against the reduced diameter portion 24*c* of the core 24 and out of engagement with the fishing neck 70. The upward movement of the piston 30 and the housing 50 continues until the shoulder 30*a* of the piston 30 engages the corresponding end of the crossover 14 at which time a portion of the snap ring 22 snaps into the groove 30*c* of the piston 30. The piston 30, and therefore the housing 50, the ring 44, the spring 46 and the dogs 40 are thus secured to the mandrel 12. The O-ring 34 extends over the slots 12*e* of the mandrel 12, and the tool 10 can be pulled from the fishing neck 70 and out of the wellbore.

It is thus seen that the pulling tool and method of the present invention permits several advantages. For example, the tool quickly and precisely latches onto an operating tool to remove the latter tool from a downhole location in a wellbore. Also, the pulling tool can be used to remove operating tool from a deviated wellbore or a jammed operating tool from any type of wellbore. In addition, the tool of the present invention can be used with the string of reeled tubing 54 and thus receive fluid for discharging through the passages 28. Further, in the event an operating tool cannot be removed from the wellbore, the pulling tool of the present invention can be hydraulically or mechanically released from the fishing neck to enable it to be retrieved from the wellbore.

It is understood that the pulling tool of the present invention is not limited to use with inside fishing necks such as the fishing neck 70, but can be modified within the scope of the invention to retrieve tools associated with outside fishing necks as disclosed in by U.S. Pat. No. 4,553,395, the disclosure of which is hereby incorporated by reference.

Other modifications, changes and substitutions is intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A tool for latching to and/or pulling a well operating tool having a fishing neck from a downhole location in pipe in a wellbore, said tool comprising:

an elongated tubular housing assembly defining a longitudinal bore;

means connecting said housing assembly to an end of a string of reeled tubing for passing said housing assembly through said wellbore and into contact with said fishing neck and for introducing fluid into said longitudinal bore;

means disposed on said housing assembly for automatically latching to said fishing neck upon said housing assembly engaging said fishing neck;

means responsive to a predetermined fluid condition in said bore for releasing said latching means from said fishing neck to permit said tool to be removed from said wellbore; and means responsive to a predetermined mechanical force exerted, via said reeled tubing, on said housing assembly and on said fishing neck for releasing said latching means from said fishing neck.

2. The tool of claim 1 further comprising at least one passage extending through said housing assembly and communicating with said longitudinal bore for discharging said fluid.

3. The tool of claim 2 wherein said first-mentioned releasing means comprises:

means for preventing the flow of fluid through said bore and said passage to enable the fluid pressure to build up in said bore; and means responsive to the buildup of a predetermined amount of said fluid pressure for releasing said latching means from said fishing neck.

4. The tool of claim 3 wherein said first-mentioned releasing means further comprises piston means mounted on said housing assembly and adapted for slidable movement relative thereto in response to said predetermined buildup of fluid pressure, and means connecting said piston means to said latching means for causing movement of said latching member out of its latching position.

5. The tool of claim 4 wherein said first-mentioned releasing means further comprises a plurality of shear pins connecting said piston means to said housing assembly, said shear pins adapted to shear in response to said predetermined buildup of fluid pressure for permitting said slidable movement of said piston means.

6. The tool of claim 5 further comprising means responsive to a predetermined amount of slidable movement of said piston means for reconnecting said piston means to said housing to lock said latching means in its released position.

7. The tool of claim 5 further comprising means responsive to a predetermined amount of slidable movement of said piston means for relieving said fluid pressure to signal that said latching means has been released.

8. The tool of claim 2 wherein said housing assembly comprises a mandrel, a tubular core having a portion extending in one end of said mandrel in a telescoping coaxial relationship thereto and means for securing said core to said mandrel.

9. The tool of claim 8 wherein the bore of said core registers with the bore of said mandrel to form a portion of said longitudinal bore, and wherein said passage extends from the inner surface of said core to the outer surface thereof at an angle to the axis thereof.

10. The tool of claim 1 wherein said latching means comprises at least one elongated latching member normally extending over said housing assembly in a parallel relation to said bore, said latching member having an enlarged end portion sized to engage a corresponding enlarged end portion of said fishing neck.

11. The tool of claim 10 further comprising resilient means normally urging said latching member in a first direction towards said fishing neck and adapted to permit slidable movement of said latching member relative to said core in a direction opposite said first direction as said housing assembly advances within said fishing neck, and means responsive to a predetermined amount of said slidable movement of said latching member in said opposite direction for pivoting said latching member so that said enlarged end portion of said latching member clears said enlarged end portion of said fishing neck, said resilient means then urging said latching member in said first direction and said pivoting means pivoting said latching member back to said parallel position to latch to said fishing neck.

12. The tool of claim 11 wherein said housing assembly comprises a mandrel, a tubular core having a portion extending in one end of said mandrel in a telescoping coaxial relationship thereto and means for securing said core to said mandrel.

13. The tool of claim 12 further comprising piston means extending over said mandrel in a coaxial telescoping relationship, shear means connecting said piston means to said mandrel, and means connecting said latching member to said piston means for movement therewith.

14. The tool of claim 13 wherein said first-mentioned releasing means comprises a passage means extending through said mandrel and registering with the bore of said mandrel, and a gap formed between said piston means and said mandrel, said fluid passing through said passage and into said gap in response to its pressure obtaining a predetermined value to shear said shear means and drive said piston means and therefore said latching member in said opposite direction.

15. The tool of claim 14 wherein, during said movement of said latching member in said opposite direction, said pivoting means pivots said latching member out of engagement with said fishing neck to release said latching member.

16. The tool of claim 15 further comprising means responsive to a predetermined amount of slidable movement of said piston means for reconnecting said piston means to said housing to lock said latching means in its released position.

17. The tool of claim 15 further comprising means responsive to a predetermined amount of slidable movement of said piston means for relieving said fluid pressure to signal that said latching means has been released.

18. The tool of claim 11 wherein said second-mentioned releasing means comprises piston means disposed on said housing assembly and connected to said latching means for engaging said fishing neck when said latching means is latched to said fishing neck, said piston means moving said latching means in said opposite direction in response to a predetermined amount of force exerted by said reeled tubing on said housing assembly and on said fishing neck, to move said latching means in said opposite direction.

19. The tool of claim 18 wherein, during said movement of said latching member in said opposite direction, said pivoting means pivots said latching member out of engagement with said fishing neck to release said latching member.

20. The tool of claim 18 wherein said second-mentioned releasing means further comprises a plurality of shear pins connecting said piston means to said housing assembly, said shear pins adapted to shear in response to said predetermined amount of force exerted by said reeled tubing for permitting slidable movement of said piston means relative to said housing assembly.

21. The tool of claim 20 further comprising means responsive to a predetermined amount of slidable movement of said piston means for reconnecting said piston means to said housing assembly to lock said latching means in its released position.

* * * * *